United States Patent [19]

Suck

[11] Patent Number: 4,873,752

[45] Date of Patent: Oct. 17, 1989

[54] MANUFACTURING METHOD OF THE GAS-FLOW VALVE NOZZLE OF A LIGHTER

[76] Inventor: Yoon-Gi Suck, 1092-35, Daerim 2dong Youngdeungpo-ku, Seoul, Rep. of Korea, 150

[21] Appl. No.: 156,350

[22] Filed: Feb. 16, 1988

[30] Foreign Application Priority Data

Apr. 13, 1987 [KR] Rep. of Korea ..... 87-3518

[51] Int. Cl.[4] ..... B21K 21/08

[52] U.S. Cl. ..... 29/157 C; 29/157 T; 72/356; 72/370

[58] Field of Search ..... 29/157 C, 157 T, 157 R; 72/370, 356; 10/11 A; 431/144; 131/234

[56] References Cited

U.S. PATENT DOCUMENTS

| | | | |
|---|---|---|---|
| 1,152,858 | 9/1915 | Steward | 72/356 X |
| 1,634,274 | 3/1926 | Smith | 29/157 C |
| 1,979,104 | 10/1934 | Gordon | 29/157 C |
| 2,391,766 | 12/1945 | Barnhart | 72/370 |
| 2,952,071 | 9/1960 | Burt | 29/157 C |
| 3,838,592 | 10/1974 | Goward | 72/356 X |
| 4,170,890 | 10/1979 | Kojima | 72/370 X |
| 4,406,143 | 9/1983 | Patula | 72/370 X |

OTHER PUBLICATIONS

05341S–M, Tekkosho, Bolt Shaping Apparatus, 1/1971, Japan.

56–11119(A), Kogyo, Manufacture of Stepped Hollow Shaft, 4/1981, Japan.

Koms, 133609, Press Forming Copper Tube Fitting in One Operation, 10/1979, Japan.

*Primary Examiner*—Timothy V. Eley
*Assistant Examiner*—Peter Dungba Vo
*Attorney, Agent, or Firm*—Lawrence M. Nawrocki

[57] ABSTRACT

A method of manufacturing gas-flow valve nozzle of a lighter by continuous plastic working processes.

6 Claims, 4 Drawing Sheets

(c)
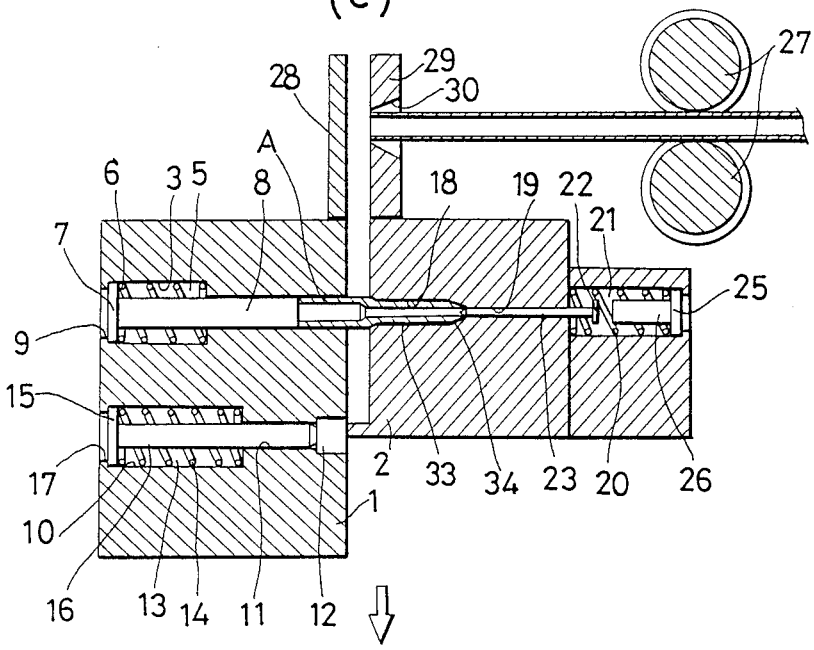
(d)
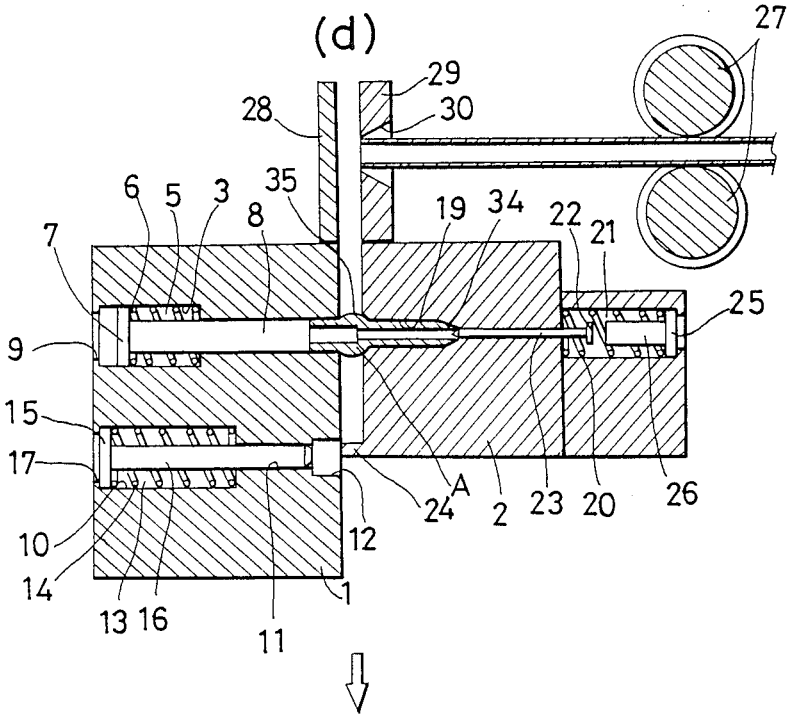

(e)
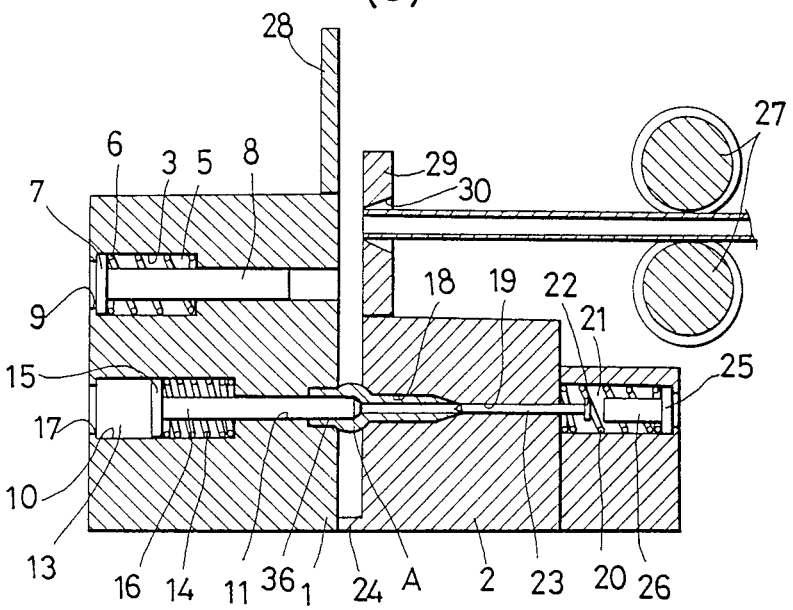
(f)
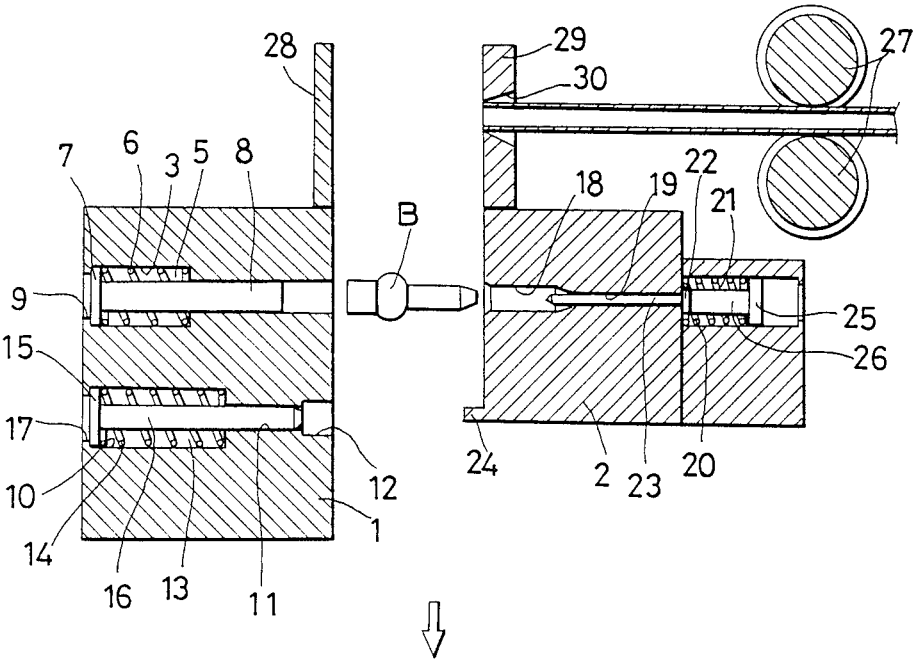

(g)
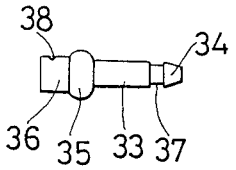
FIG. 2
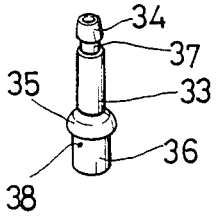
FIG. 3
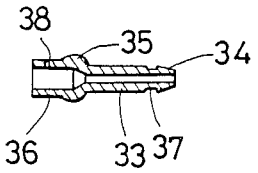
FIG. 4
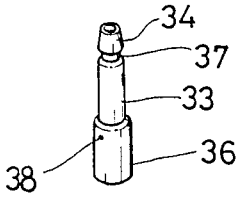

MANUFACTURING METHOD OF THE GAS-FLOW VALVE NOZZLE OF A LIGHTER

The present invention relates to a manufacturing method of the gas-flow valve nozzle and in particular to the continuous manufacturing processes of the said nozzle by plastic working.

BACKGROUND OF THE INVENTION

Gas or liquefied-gas is used as fuel in a lighter, and various types of consummable lighters using liquefied-gas have been developed. Such gas lighters have gas-flow valves which regulate gas flow to a desirable level. The present invention relates to a method for manufacturing a metal valve nozzle which is a part of the gas-flow valve.

In conventional manufacturing methods of a gas-flow valve nozzle, finished products are made by using automatic lathes or equipments specifically for making the valve nozzle, which equipments form material to a shape of a valve nozzle using a bit which is employed to drill the valve nozzle to provide a gas-flow hole and a valve hole. In these manufacturing methods, the great cost of production creates an enormous economic burden. Because of wasted time and labour, the efficiency of production is low, and gas leaks frequently result due to poorly formed surfaces.

SUMMARY OF THE INVENTION

The goal of the present invention is to remedy these disadvantages by providing a continuous manufacturing process which comprises several plastic working steps and several cutting and drilling steps. The first objective of the present invention is to provide a simple manufacturing method employing plastic working steps in substitution for conventional, complicated cutting working steps. The second objective of the present invention is to improve the accurateness of forming of worked faces by using plastic working. The third objective of the present invention is to improve the efficiency by reducing the economic burden and the economic inefficiency of conventional manufacturing methods of a gas-flow valve nozzle. In effect, the present invention provides for 10 times the production efficiency of a manufacturing method utilizing lathes, and about 3–4 times the production efficiency of a manufacturing method using machines excusively for gas-flow valve nozzles.

To accomplish these purposes, the present invention comprises continuous manufacturing steps of plastic working processes capitalizing upon the fact that the cold working of copper can be performed at a room temperature. In order to embody the technical idea in the present invention, the invention uses a copper, circular bar-shaped pipe, i.e. having hollow cross-section, as a material for working, and comprises continuous steps, wherein: The first step involves drawing a copper pipe to the fixed position; the second step involves cutting said copper pipe so as to be the same length as that of a valve nozzle and transferring said cut copper pipe to the fixed position; the third step involves forming a tube and a tapering tip; the fourth step involves forming an annular protrusion having a hollow cross-section; the fifth step involves forming a large diametered tube; the sixth step involves withdrawing the partially-formed product to the outside; the seventh step involves forming a catching portion and a valve hole, and grinding the surface of the valve nozzle.

BRIEF DESCRIPTION OF THE DRAWINGS

Several steps of the invention will be described hereinbelow with reference to the attached drawings, wherein.

Figure 1:
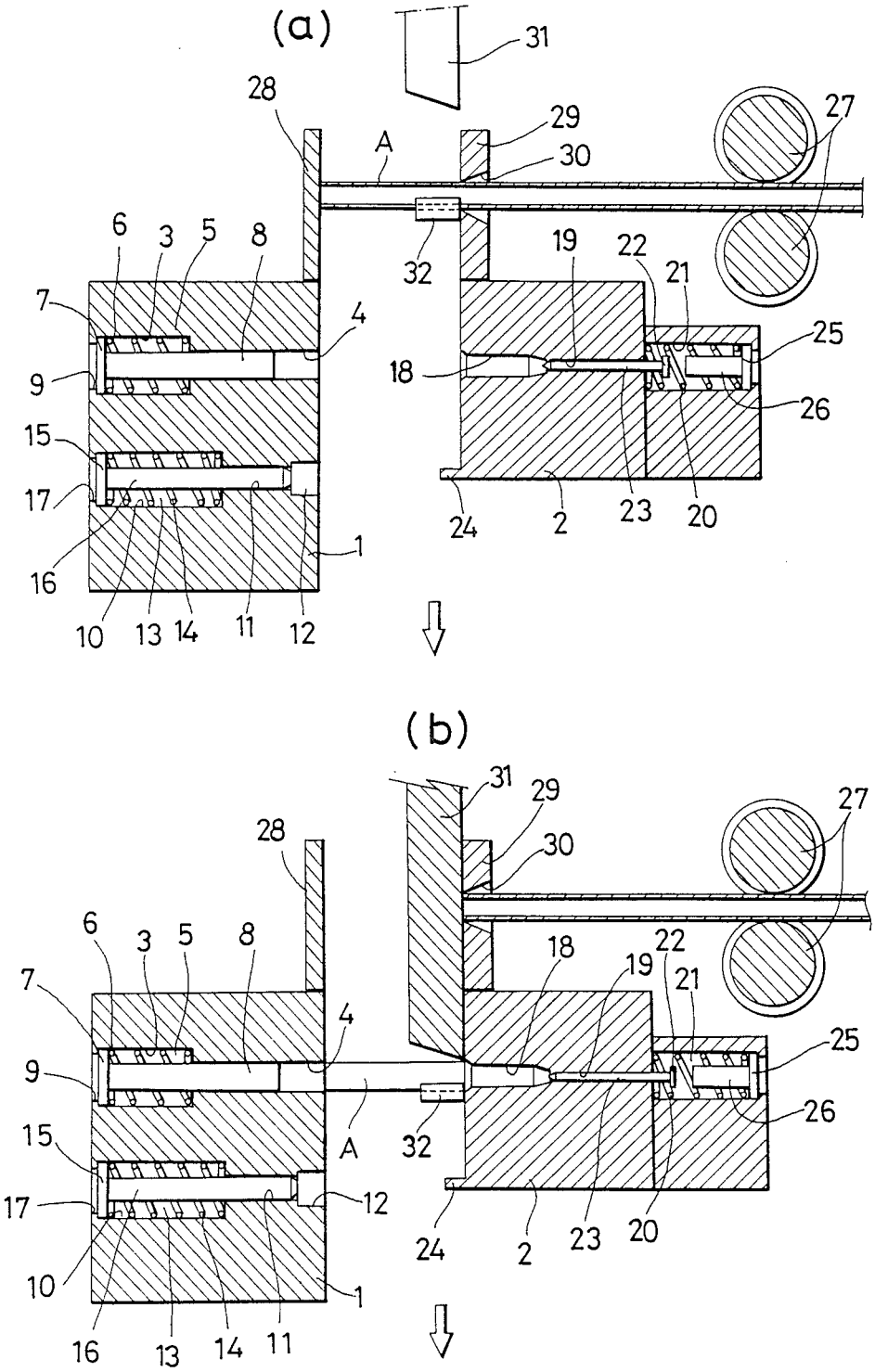
FIG. 1 represents the manufacturing steps according to the present invention.

(A) shows the first step,
(B) shows the second step,
(C) shows the third step,
(D) shows the fourth step,
(E) shows the fifth step,
(F) shows the sixth step,
and (G) shows the last step;

FIG. 2 shows a finished product manufactured according to the present invention;

FIG. 3 is a lengthwise cross-section of the finished product of FIG. 2;

FIG. 4 shows the finished product manufactured according o a variation of the present method invention.

DETAILED DESCRIPTION OF THE PRESENT INVENTION

As shown in (a) of FIG. 1, a device used in accordance with the present invention comprises a first die (1), a cutting punch (31), a cutting die (29), drawing rollers (27), and a second die (2).

The first die (1) consists of an upper part and a lower part. The upper part has a pin holding hole (5) which comprises a large diameter portion (3) and a first inserting hole (4), a spring (6) which is received in the large diameter portion (3) and compressed when a pin (8) moves to the right, pin (8) having a flange (7) at its left end as seen in the figures, an aperture (9) for a plunger (not shown) in the figure, and a die appendage (28). The lower part has a pin holding hole (13) which comprises a large diameter portion (10), a small diameter portion (11), a third inserting hole (12) for forming a large diametered tube of the valve nozzle, a spring (14) which is received in the large diameter portion (10) and compressed when a pin (16) moves to the right, pin (16) which has a flange (15) at its left end, as seen in the figures, and is tapered at its right end, and an aperture (17) for a plunger (not shown) in the figure.

The second die (2) is opposite the first die (1) and has the second inserting hole (18), a small hole (19), and a large hole (21). The left end of the second inserting hole (18) is tapered inward to receive a cut segment of bar material A into the second inserting hole (18) easily, and the right end of said hole (18) is also tapered to the left end of a small hole (19). In the small hole (19) is received pushing pin (23) of which the left end is conical and the right end of which has a flange (22). In the large hole (21) is received a plunger member (26) with a flange (25). The right end of the plunger member (26) is urged to the right by the spring (20) received in the large hole (21). The second die (2) has a stop (24) on the left side near the bottom.

Appendage (28) is attached on the right side of the top of the first die (1), and cutting die (29) is attached on the left side of the top of the second die (2). Cutting die (29) has a tapered cutting hole (30). The tubular bar material (A) drawn by drawing rollers (27) passes through the cutting hole (30) and stops at the appendage (28). At the left edge of the cutting die (29), cutting punch (31), fixed to a ram of a forging machine (unshown in the figures), is positioned above the cutting die (29), and the tubular bar material (A) is positioned above supporting member (32) and below the cutting die (29).

Next the manufacturing method of the gas-flow valve nozzle of a lighter will be described concisely with reference to manufacturing steps shown in FIG. 1.

(a) of FIG. 1 illustrates the first step of manufacturing. The cutting punch (31) is raised, and the tubular bar material (A) is drawn by drawing rollers (27) to the dies (1) and (2). The annular bar material passes through the cutting hole (30) and stops at the appendage (28). The first die (1) is spaced from the second die at the desired length of the valve nozzle.

(b) of FIG. 1 illustrates the second step. The cutting punch (31) descends to cut the tubular bar material (A). After cutting the bar material (A), the cutting punch (31) descends with the cut bar material (A) and the supporting member (32). When the cut bar material (A) achieves a position aligned with the first inserting hole (4) of the first die (1) and the second inserting hole (18) of the second die (2), the cutting punch (31) and the supporting member (32) stop descending.

(c) of FIG. 1 illustrates the third step. The cutting punch (31) is raised, and the supporting member (32) descends a little, moves horizontally a little so that material (A) does not obstruct upward movement, and then rises. After all of the steps are completed, the cutting punch (31) and the supporting member (32) return to the original positions. After the cutting punch (31) and the supporting member (32) are transferred from the working area, the first die (1) moves toward the second die (2). A part of the cut tubular bar material (A) is, thereby, inserted into the first inserting hole (4), and a part of the cut bar material (A) is inserted into the second inserting hole (18). Since the diameter of the second inserting hole (18) is smaller than the outer diameter of the cut bar material (A), when the material (A) is inserted in the second inserting hole (18), the diameter of the cut tubular bar material (A) is compressed. Since the right end of the second inserting hole (18) is tapered to the left end of the small hole (19), the right tip of the inserted bar material becomes tapered also. The nozzle (33) and the tapering tip (34) are, thereby, formed.

(d) of FIG. 1 illustrates the fourth step. A plunger (not shown in the figure) urges the pin (8), in the pin hole (3) of the upper part of the first die (1), to the right. As the pin (8) moves to the right, it longitudinally compresses the tubular bar material (A). Then, between the first die (1) and the second die (2), an annular protrusion (35) is formed.

(e) of FIG. 2 illustrates the fifth step. After the annular protrusion (35) is formed completely, the first die (1) moves to its original position, whereby the tubular bar material (A) is withdrawn from the first inserting hole (4). Then, after the first die (1) is raised to a position wherein the third inserting hole (12) of the first die (1) is registered with the second inserting hole (18) of the second die (2), the first die (1) moves toward the second die (2) till the first die (1) touches the stop (24). During this motion a part of the bar material (A) is inserted into the third inserting hole (12). When the left end of the annular bar material (A) is inserted fully to the left end of the third inserting hole (12), a plunger (not shown in the figure) hits the pin (16) so that the pin (16) is inserted into the left end of the tubular bar material (A). Because the diameter of the pin (16) is larger than that of the bar material (A), when the pin (16) is inserted into the bar material (A), the diameter of the portion of the tubular bar material to the left of protrusion (35) expands, and the outer surface of the bar material (A) comes to contact closely the inner surface of the third inserting hole (12).

(f) of FIG. 1 illustrates the sixth step. The first die (1) moves to the left so that the half-finished valve nozzle (B) is withdrawn from the third inserting hole (12). When the half-finished valve nozzle (B) is withdrawn, the first die (1) is lowered and returns to its original position. In this state, the half-finished valve nozzle (B) is shorter than that of the original bar material stock of step (b) of FIG. 1. Therefore, when the plunger member (26) hits the pushing pin (23), the pushing pin (23) ejects the half-finished valve nozzle (B).

(g) of FIG. 1 illustrates the seventh step. In this step the catching portion (37) is cut, the valve hole (38) is drilled, and surfaces of the tube (33), the large diametered tube portion (36), and the annular protrusion (35) are ground.

In accordance with the version of FIG. 1 the manufacturing method of the gas-flow valve nozzle of a lighter comprises seven steps, and the finished valve nozzle is as shown FIGS. 2 and 3. FIG. 2 shows the appearance of the valve nozzle and FIG. 3 shows the lengthwise cross-section of the valve nozzle of FIG. 2.

FIG. 4 shows a finished product manufactured according to a variation of the method invention.

In this variation, the fourth step of forming the annular protrusion (35) and the grinding work of the annular protrusion (35) in the seventh step are not performed. Therefore, the valve nozzle of FIG. 4 doesn't have the annular protrusion (35). The other portions, however, are the same as the parts of the valve nozzle of FIG. 2.

As previously mentioned, the present invention comprises continuous steps of plastic workings so the manufacturing method is simple and cheap. As well it is possible to mass-produce the valve nozzle.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

I claim:

1. A method of manufacturing a gas-flow valve nozzle, comprising the steps of:

(a) drawing a segment of tubular bar material to a location above a space between first and second dies;

(b) cutting a segment of the bar material to a length substantially the same as the distance between the first and second dies, and urging the cut portion of bar material into the space between the first and second dies so that one end of the segment is registered with a first hole in the first die, and the other end of the bar material is in registration with a second hole in the second die;

(c) moving the first die relatively toward the second die so that ends of the segment of bar material enter the respective first and second holes with which they are registered, wherein an end of the segment entering the second hole in the second die is compressed and tapered by an inner wall defining the second hole;

(d) urging the segment of bar material out of the first hole in the first die some measure so that an annular protrusion is formed on the segment as the segment plastically deforms into a narrow space maintained between the first and second die;

(e) retaining the segment of bar material in the second hole while the first die is withdrawn away from the second die so that the end of the segment of bar material received within the first hole is retracted therefrom, moving the first die so that the end of the segment of bar material previously received within the first hole comes into registration with a third hole, having a diameter greater than that of the end of the segment of bar material, formed in the first die, closing the first die toward the second die so that the end of the segment of bar material enters the third hole, and expanding the end of the segment of bar material received within the third hole until its diameter achieves that of the third hole;

(f) withdrawing the first die away from the second die so that the segment of bar material is retracted from the third hole, and ejecting the segment of bar material from the second hole in the second die; and (g) machining the segment of bar material processed in accordance with steps (a)-(f) to render the segment a finished gas-flow nozzle.

2. The method in accordance with claim 1 wherein step (a) includes drawing the bar material into position by employing a pair of rollers, and urging the bar material into engagement with an appendage carried by the first die.

3. The method in accordance with claim 1, wherein step (b) includes providing a cutting punch, cutting the bar material to length by using said cutting punch, and transferring the cut segment of bar material into position in registration with the first and second holes in the first and second dies, respectively, by means of said cutting punch and a supporting member on which the bar material is seated as it is cut by said cutting punch.

4. The method in accordance with claim 1 wherein step (d) includes providing a plunger and disposing the plunger in the first hole, and wherein the plunger is moved longitudinally within the first hole to effect plastic deformation of the segment of bar material.

5. The method in accordance with claim 1 wherein step (e) includes providing a pin received within the third hole for telescoping movement therewithin, the pin being provided with an outer diameter greater than the inner diameter of the segment of bar material received within the third hole, and wherein the pin is urged into a passage formed in the segment of bar material, at the end received within the third hole, to expand that end of the segment of bar material.

6. The method in accordance with claim 1 wherein step (f) includes providing the second hole in the second die with a plunger member, and wherein the partially-processed segment of bar material is ejected from the second hole by urging the plunger member disposed within the second hole against the segment of bar material.

* * * * *